US005782617A

United States Patent [19]

Habla

[11] Patent Number: 5,782,617

[45] Date of Patent: Jul. 21, 1998

[54] CAPSULE-TYPE DOSING PUMP

[76] Inventor: Gerhard Habla, Krokusweg 4, 86863 Langenneufnach, Germany

[21] Appl. No.: 692,586

[22] Filed: Aug. 6, 1996

[30] Foreign Application Priority Data

Aug. 7, 1995 [DE] Germany ..... 295 12 694 U

[51] Int. Cl.[6] ..... F04B 43/06

[52] U.S. Cl. ..... 417/395; 417/403

[58] Field of Search ..... 417/392, 395, 417/401, 403, 413.1; 92/98 D, 128, 6

[56] References Cited

U.S. PATENT DOCUMENTS

| | | | |
|---|---|---|---|
| 3,544,239 | 12/1970 | Graham | 417/403 |
| 3,672,791 | 6/1972 | Zimmerly . | |
| 3,781,141 | 12/1973 | Schall | 417/401 |

FOREIGN PATENT DOCUMENTS

| | | |
|---|---|---|
| 0 536 818 | 4/1993 | European Pat. Off. . |
| 2 146 019 | 2/1973 | France . |
| 2 466 640 | 4/1981 | France . |
| 1 767 453 | 9/1971 | Germany . |

*Primary Examiner*—Charles G. Freay
*Attorney, Agent, or Firm*—Klaus J. Bach

[57] ABSTRACT

A capsule-type dosing pump wherein the minimum volume of the pump capsule is reduced substantially to zero through use of a stationary capsule wall which is shaped so as to complement, i.e., to conform to, the bulged-out shape of the capsule diaphragm when in its most forward position, and wherein means are provided for ensuring that the capsule diaphragm, when in its most forward position thereof, will lie flush against the complementary surface of the stationary capsule wall so as to prevent pockets of liquids from forming therebetween.

17 Claims, 4 Drawing Sheets

CAPSULE-TYPE DOSING PUMP

BACKGROUND OF THE INVENTION

Capsule-type pumps utilize pump chambers formed as capsules defined partly by a stationary wall and partly by a movable wall which takes the form of a diaphragm, by means of an operating plunger, between one end position providing minimum capsule volume and another end position providing maximum capsule volume. The stationary capsule wall includes an inlet port having associated therewith an inlet check valve, and a outlet port having associated therewith an outlet check valve, the arrangement being such that movement of the capsule diaphragm to its maximum-volume end position will cause liquid to be sucked into the pump capsule through the inlet port, and movement of the capsule diaphragm to its minimum-volume end position will cause the liquid to be forced out of the pump capsule through said outlet port.

The present invention has for its principal object to adapt a capsule-type pump of the above-mentioned kind for use as a dosing or metering pump or, in other words, to provide an improved capsule-type pump which is capable of delivering a specific volume of liquid during each operating stroke of the capsule diaphragm, i.e., which in the end positions of the capsule diaphragm accurately provides a specific maximum volume and minimum volume.

SUMMARY OF THE INVENTION

The present invention begins with a recognition that the problem with a conventional capsule-type pump resides not in an inadequate reproducibility of its maximum capsule volume but in an inadequate reproducibility of its minimum capsule volume. This is due to the fact that whilst the dimensions and the bending characteristics of the capsule diaphragm allow a sufficiently accurate reproducibility of the capsule volume to be readily achieved in the maximum-volume end position of the capsule diaphragm (assuming, of course, the movements of the operating plunger for the diaphragm are sufficiently precise, which to assure poses to problem), it is practically impossible to accurately reproduce the desired diaphragm configuration in the minimum-volume position of the capsule diaphragm, i.e., when the latter is arched forward. The reason for this is that, depending on the elasticity of the capsule diaphragm, the inertia of the outlet check valve, the viscosity of the liquid being pumped, and other, partly accidental factors, there is a tendency for pockets of liquid to form, during discharge stroke, between the forwardly arched capsule diaphragm and the stationary capsule wall, which liquid pockets prevent an exact volumetric output from being consistently obtained with conventional capsule-type pumps. This poses no problem with conventional capsule-type pumps utilized only as feed pumps, but it does render such pumps unsuitable for use as dosing or metering pumps.

The present invention attains its stated objective by providing a capsule-type dosing pump wherein the minimum volume of the pump capsule is reduced substantially to zero through use of a stationary capsule wall which is shaped so as to complement, i.e., to conform to, the bulged-out shape assumed by the capsule diaphragm when in its most forward position, and wherein means are provided for ensuring that the capsule diaphragm, when in the most forward position thereof, will lie flush against the complementary surface of the stationary capsule wall so as to prevent pockets of liquids from forming therebetween.

The invention will become more readily apparent from the following description of preferred embodiments thereof described, by way of example only, with reference to the accompanying drawings.

DESCRIPTION OF THE PREFERRED EMBODIMENTS

Figure 1:
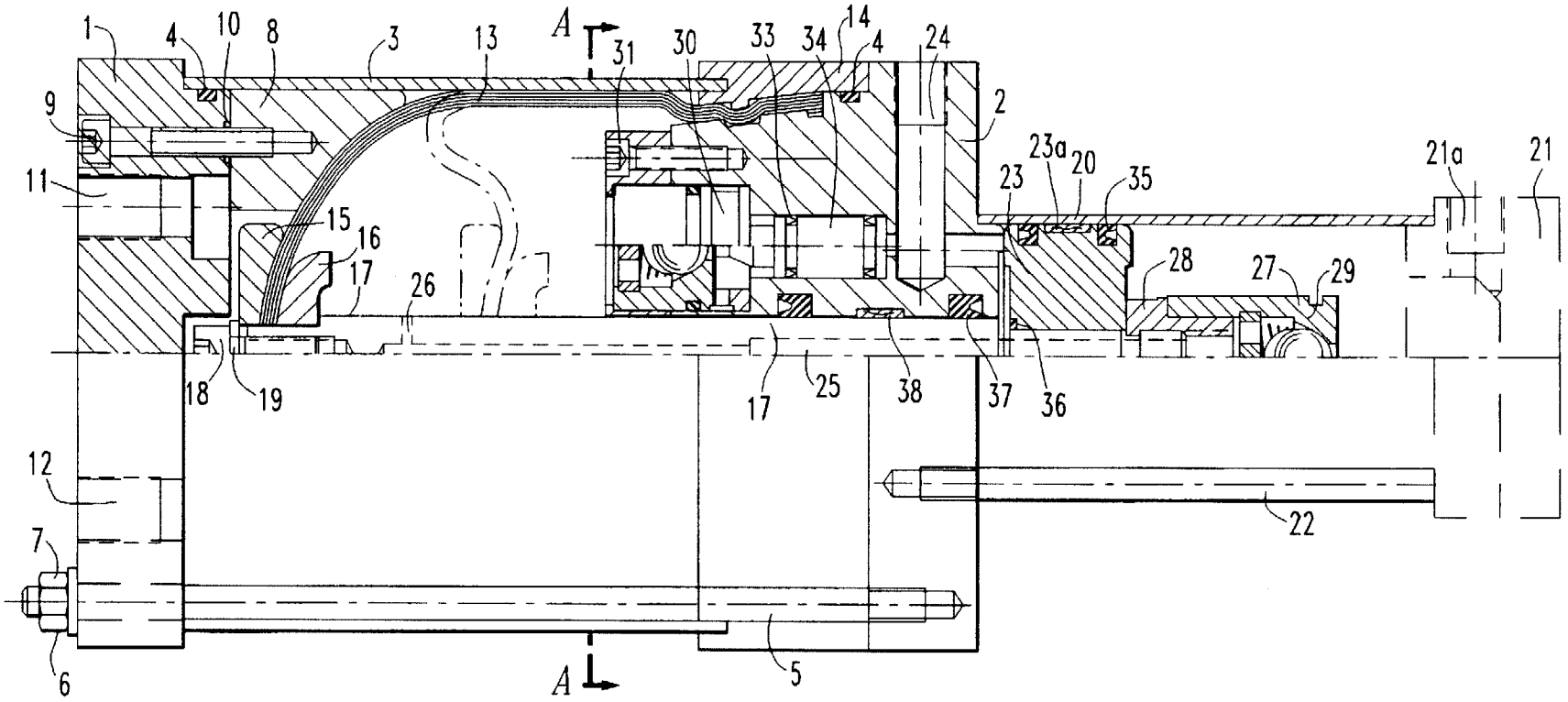
FIG. 1 illustrates a dosing or metering pump embodying the invention, the lower half of the pump being shown in side elevation, and the upper half thereof being shown longitudinally sectioned.
Figure 2:
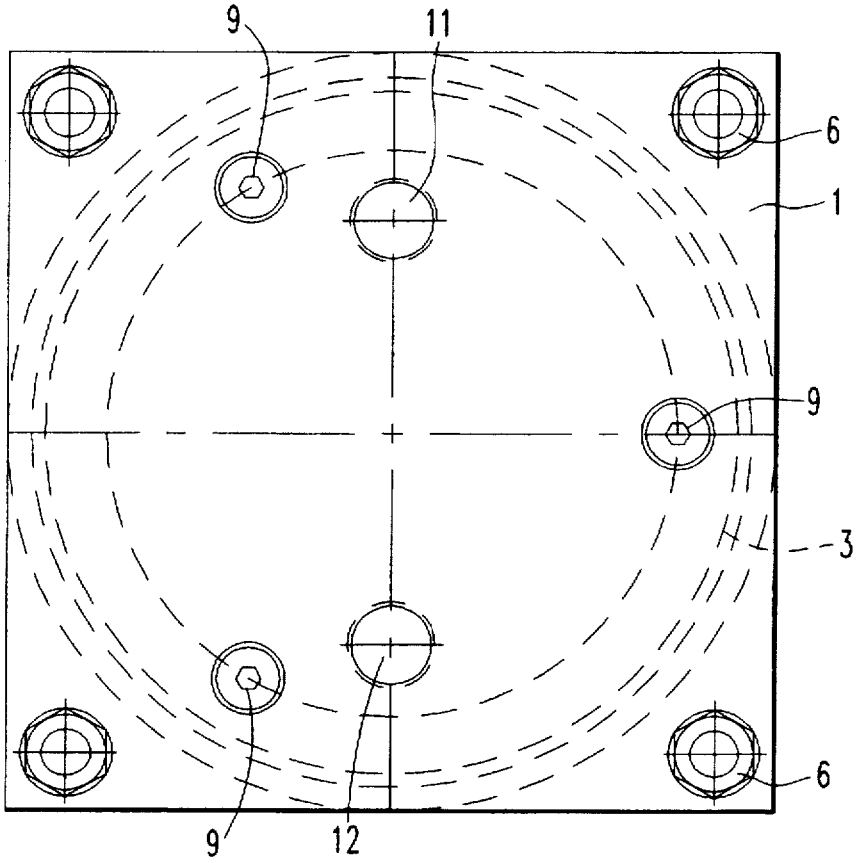
FIG. 2 is an elevational view of the left-hand end of the dosing pump shown in FIG. 1.
Figure 4:
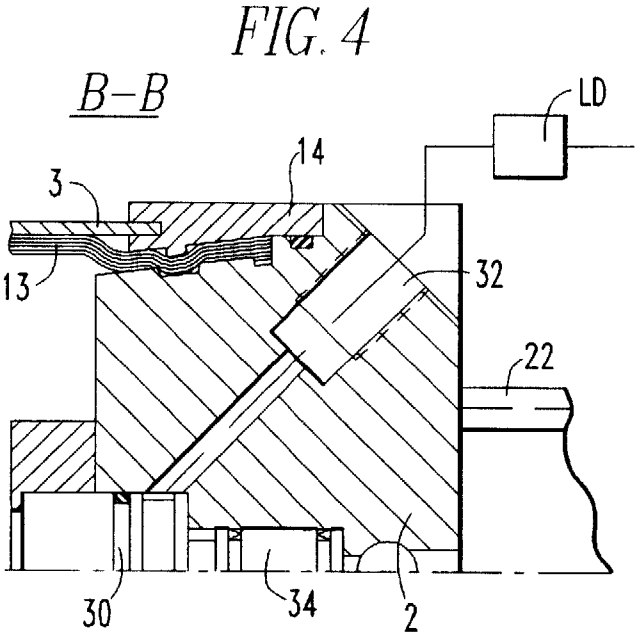
FIG. 4 is a sectional view taken along line B—B in FIG. 3.
Figure 3:
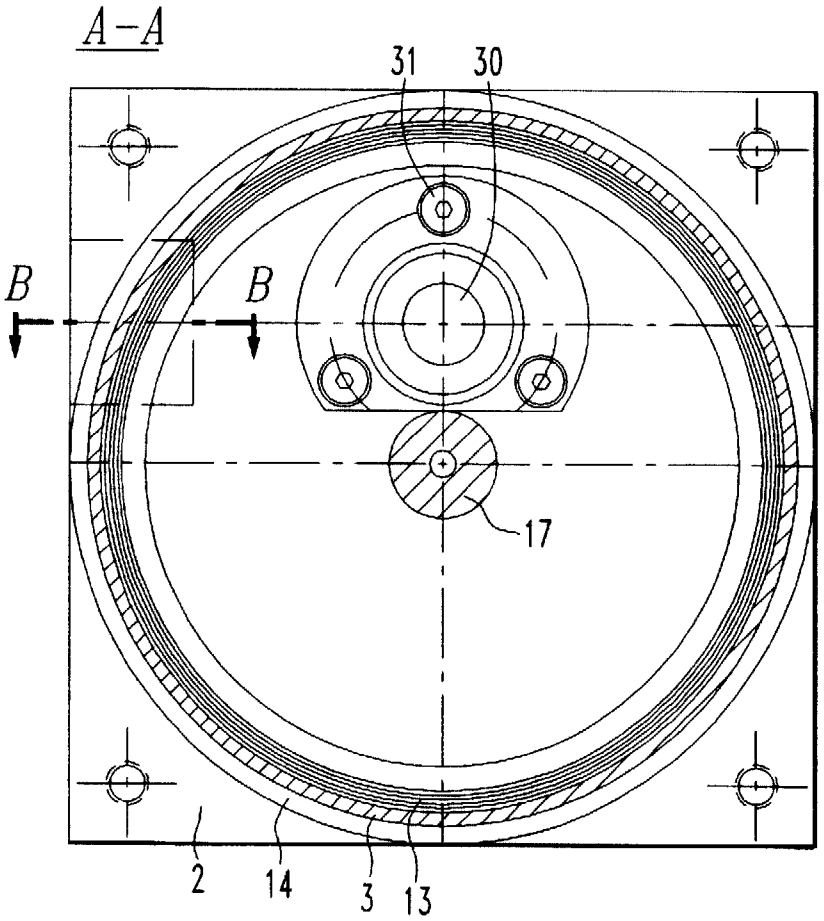
FIG. 3 is a cross-sectional view taken along line A—A in FIG. 1.

It should be noted that the same reference characters will be used herein to designate essentially identical parts utilized in both embodiments (FIGS. 1–4 and FIG. 5).

Referring now to FIGS. 1 to 4 of the drawings, the casing of the capsule-type dosing or metering pump shown therein comprises a front end flange 1, a rear flange 2, a cylindrical tubular wall 3 extending axially between the flanges 1 and 2, with a seal 4 disposed between the tubular wall 3 and the front end flange 1, and four tie rods 5 extending, exteriorly of the tubular wall 3, between the flanges 1, 2 and tying them together, each of the tie rods 5 being provided with a nut 7 and washer 6.

The front flange 1 has a concave base member 8 secured to the inner surface thereof by means of screws 9 and with seals 10 provided between the base member 8 and the front flange 1 at the screws 9. The base member 8 and the remaining, i.e., exposed, inner surface portion of the front end flange 1 constitute the stationary capsule wall of the dosing pump. The stationary capsule wall has an inlet port 11 and an outlet port 12 both disposed in the front end flange 1. Inlet and outlet check valves (not shown) associated with the inlet and outlet ports 11, 12 may be incorporated in corresponding inlet and outlet pipes (not shown).

The movable capsule wall is formed by a capsule diaphragm 13 which has a rear portion thereof securely clamped in place between a conical peripheral surface of the rear flange 2 and an outer clamp ring 14 with a wedge-shaped cross-section (see FIG. 1) mounted thereon, a seal ring 4 being disposed between the clamp ring 14 and the rear flange 2. The clamp ring 14 serves also to connect the tubular wall 3 to the rear flange 2.

The capsule diaphragm 13 has further a cylindrical middle portion abutting the inner surface of the tubular wall 3, and a front or active portion which is movable to a forwardly arched or bulged-out position, wherein it is seated flush against the concave rear face of the base member 8, as shown in FIG. 1, and to a retracted or rear position as shown in phantom in FIG. 1.

The active portion of the capsule diaphragm 13 has a middle section thereof clamped between two form pieces 15 and 16, and secured to an operating plunger 17 by means of fasteners 18, 19.

The rear flange 2 of the dosing pump is actually an intermediate flange insofar as it is adjoined to the rear thereof by a pneumatic cylinder including a cylinder wall 20 which extends between the flange 2 and a cylinder end flange 21, the whole assembly being held together by means of tie rods 22.

The pneumatic cylinder includes further a double-acting piston 23 for actuating the operating plunger 17, the piston 23 being movable within the cylinder axially to and fro, and being connected to the rear end of the operating plunger.

The end flange 21 of the pneumatic cylinder has formed therein a compressed-air inlet 21*a* for pressurizing the pneumatic cylinder from one side thereof so as to cause its piston 23 to drive the operating plunger 17 forward (toward the left, as viewed in FIG. 1) and thereby move the active portion of the capsule diaphragm 13 to its forwardly arched or bulged-out position. The flange 2 has formed therein a compressed-air inlet 24 and an axial bore for pressurizing the pneumatic cylinder from the opposite side so as to cause the piston 23 to retract the operating plunger 17 and thereby move the active portion of the capsule diaphragm 13 to its retracted position shown in phantom in FIG. 1.

The operating plunger 17 has formed therein an axial bore 25 which communicates, through a radial bore 26 of the plunger, with the space behind the diaphragm 13, and which communicates also, through a ball-type check valve 27 including housing parts 28, 29, with that side of the pneumatic cylinder pressurization of which will cause the piston 23 to move the operating plunger 17 and the active portion of the capsule diaphragm 13 to their most forward position. As seen from the drawing, the check valve 27 is normally closed and is oriented such as to be opened when the pneumatic cylinder is pressurized from the side thereof effecting movement of the piston 23, the plunger 17, and the active portion of the diaphragm 13 to the most forward position thereof (i.e., toward the left, as seen in FIG. 1). Upon opening, the check valve 27 will allow air to flow from the pressurized side of the pneumatic cylinder through the axial and radial bores 25,26 of the plunger 17 and into the space behind the capsule diaphragm 13 so that said space is pressurized at the same time air pressure is applied to the piston 23 causing it to move the active portion of the capsule diaphragm 13 to its forward or bulged-out position. This will assure that the active portion of the capsule diaphragm 13 is firmly forced flush against the concave surface of the base member 8 so that as to prevent any remaining pockets of liquid between the base member and the capsule diaphragm from forming during a discharge stroke of the dosing pump.

The dosing pump includes further a ball-type check valve 30 disposed in the flange 2 and secured thereto by means of screws 31. The check valve 30 communicates with the space behind the capsule diaphragm 13 and is normally closed to prevent pressure escape therefrom. The other side of the check valve 30 is connected with an outlet passageway 32 (see FIG. 4) formed in the flange 2 and extending to the outside thereof.

Said other side of the check valve 30 is connected also with the compressed-air inlet 24 of the flange 2 through an axial bore 33 which has a control piston 34 slideably disposed therein.

As mentioned above, the ball-type check valve 30 is biased so as to prevent the escape of air from the space behind the capsule diaphragm 13 when said space is being pressurized. When air under pressure is admitted through the compressed-air inlet 24 and applied to the right-hand side (as viewed in FIG. 1) of the control piston 34, it will displace the latter toward the left and thereby cause it to push the ball of the check valve 30 to its open position against the action of its bias, thereby defeating the normally closed check valve 30.

The dosing valve so far described herein operates as follows:—When air under pressure is supplied to the pneumatic cylinder through the inlet 21*a* in the end flange 24 thereof, the double-acting piston 23 is actuated to push the operating plunger 17 forward, thereby moving the active portion of the capsule diaphragm to its bulged-out position. Simultaneously therewith, the increased pressure in the cylinder space to the rear of the piston 23 causes the check valve 27 to open and thereby allow compressed air to pass from the cylinder and through the axial and radial bores 25,26 of the plunger 17 into the space behind the capsule diaphragm 13. It should be noted that the compressed-air inlet 24 in the flange 2 is at zero pressure at this time so that the check valve 30 remains closed and air cannot escape from the space behind the capsule diaphragm 13.

When the pneumatic drive is switched to reverse in order to initiate a suction stroke, i.e., when air pressure is removed from the compressed-air inlet 21*a* leading to the pneumatic cylinder and compressed air is supplied to the inlet 24 in the flange 2, the check valve 27 communicating with the now depressurized chamber of the pneumatic cylinder will close, whilst the increased pressure in the inlet 24 of the flange 2 will drive the control piston 34 within the bore 33 to the left, as viewed in FIG. 1, thereby causing it to open the check valve 30 so as to release the pressure in the space behind the capsule diaphragm 13 through the outlet passage 32. At the same time, the compressed air supplied to the inlet 24 in the flange 2 reaches also the left-hand side (as viewed in FIG. 1) of the double-acting piston 23 and drives the latter toward the right, thereby effecting a suction stroke by causing the operating plunger 17 to pull the active portion of the capsule diaphragm 16 backward to the retracted position (shown in phantom in FIG. 1) thereof, whereby liquid is drawn in through the inlet port 11 of the pump.

As set forth above, the outlet passage 32 (FIG. 4) in the flange 2 serves to depressurize the space behind the diaphragm 13. Moreover, by pressurizing said space during each forward or discharge stroke and depressurizing it through the outlet passage 32 during each return or suction stroke, the space behind the capsule diaphragm is constantly flushed so that in the event there is some small leakage, it will be purged from the pump during operation thereof and, even if of an aggressive nature, will have no time to attack and damage the pump mechanism. It would also be readily feasible to connect to the outlet passage 32 (FIG. 4) a suitable leakage detector LD capable of determining the kind and amount of any leakage possibly occurring.

Finally, and again with reference to FIG. 1, the piston 23 is provided with an oil groove 23*a* and two oil seals 35 on its outer peripheral surface, and with a seal 36 next to the portion of the plunger extending axially therethrough. Oil seals 37 and an oil groove 38 are provided also in the wall of the axial bore of the flange 2 in which the operating plunger 17 is slideably supported.

Figure 5:
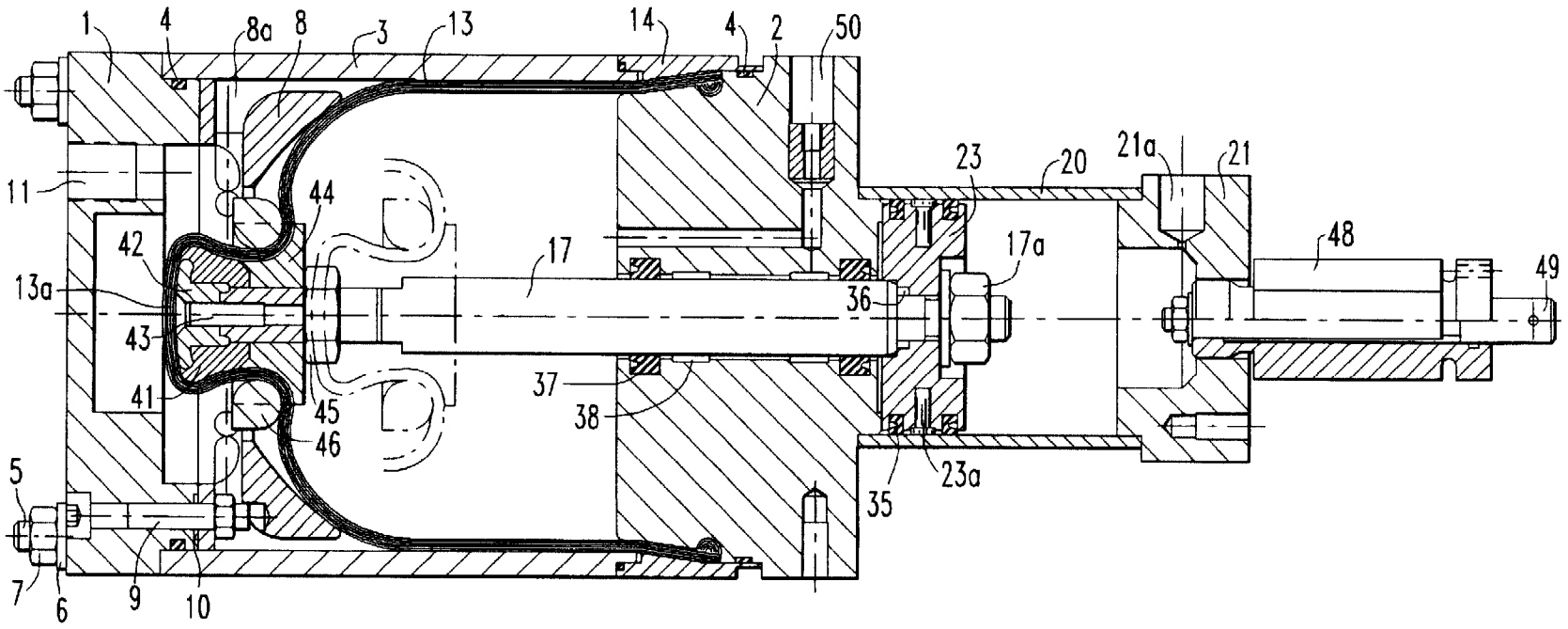
FIG. 5 is a longitudinal sectional view of a further improved capsule-type dosing pump embodying the invention.

Referring now to FIG. 5 illustrating another embodiment of the invention, the capsule-type dosing or metering pump shown therein includes features which represent substantial further improvements over the embodiment shown in FIGS. 1 to 4.

Just like the dosing pump previously described herein, the one illustrated in FIG. 5 comprises a front end flange 1 having an inlet port 11 and an outlet port (not visible in FIG. 5), a rear flange 2, a cylindrical tubular wall 3 extending between the front and rear flanges, seals 4, tie rods 5 with washers 6 and nuts 7, a base member 8 secured in place by means of screws 9 and with a gasket 10 disposed between the base member 8 and the end flange 1, a capsule diaphragm 13, and a clamp ring 14 securing the diaphragm to the flange 2.

The dosing pump of FIG. 5 also includes a pneumatic cylinder which is supported from the rear surface of the end flange 2 and comprises a cylinder wall 20 and a rear end flange 21, and in which pneumatic cylinder there is disposed a double-acting piston 23. An operating plunger 17 slideably supported in an opening extending through the rear flange 2 is connected at the rear end thereof to the piston 23 by means of a nut 17*a*, and is connected at its front end to a middle section of the front or active portion of the capsule diaphragm 13. The end flange 21 of the pneumatic cylinder is provided with a compressed-air inlet 21*a* for introducing compressed air driving the piston 23 forward (i.e., toward the left, as viewed in FIG. 5) to effect a discharge stroke. The air inlet for introducing compressed air driving the piston 23 in the opposite direction, i.e., rearward, so as to effect a suction stroke is not seen in FIG. 5.

The piston 23 is provided with an oil groove 23*a* and oil seals 35 at the outer peripheral surface thereof, and with a seal 36 next to the plunger 17. The flange 2 includes oil seals 37 and oil grooves 38 disposed in the wall surface of the axial opening in which the plunger 17 is slideably supported.

As mentioned hereinbefore, the modified dosing pump shown in FIG. 5 is an improved version of the basic design shown in FIGS. 1 to 4.

The first important improvement resides in the design of the base member 8. In the embodiment shown in FIG. 1, the base member constitutes a solid annular body having a center opening large enough to receive the retainers (form pieces 15, 16) on the front or active portion of the capsule diaphragm 13.

As distinct therefrom, the base member 8 of the embodiment illustrated in FIG. 5 is provided with an annular array of channels 8*a* connecting the space, which is defined by the center opening of the annular base member 8 and communicates with the inlet port 11, with the space forming the radially outer transition region between the surface of the base member 8 facing the capsule diaphragm 13 and the inner surface of the tubular wall 3.

This has the advantage of enabling the active portion of the capsule diaphragm 23 to be retracted more easily and quickly during a suction stroke effected by the piston 23 when moved backward, because liquid can be readily drawn by the retreating active portion of the capsule diaphragm through the channels 8*a* and into said radially outer transition region so that cavitation drag on the rearwardly moving active portion of the diaphragm is greatly reduced. Thus, whereas in the embodiment according to FIG. 1 all of the liquid drawn through the inlet port 11 during a suction stroke must flow through the central opening of the base member 8 before it can radially expand into the space widening between the concave surface of the base member and the diaphragm portion as the latter is separating from the concave surface, in the embodiment according to FIG. 5 liquid drawn through the inlet port 11 during a suction stroke will flow both through the central opening of the base member 8 and also radially outward through the channels 8*a*.

Thus, with the base member 8 constructed as shown in FIG. 5, there will be no cavitation so that it will be possible to achieve greater pumping speeds; and since there can be no cavitation bubbles, dosages can be still more precise. Moreover, the active portion of the capsule diaphragm will move more smoothly and supply and, hence, be subject to less molecular friction so that the diaphragm will attain a substantially longer useful life and or, in other words, be able to perform a much greater number of pumping strokes.

The second important improvement in the arrangement according to FIG. 5 resides in the particular construction of the capsule diaphragm 13.

Whereas in FIG. 1 the capsule diaphragm utilized in the first embodiment is shown to have formed in the center region of the active portion thereof a hole for receiving the end portion of the operating plunger 17 between the two form pieces 15 and 16, the generally cup-shaped capsule diaphragm of the embodiment shown in FIG. 5 has no such hole and is completely closed, thus guaranteeing a 100 percent isolation of the spaces in front and behind the capsule diaphragm 13 from one another. Of course, since the diaphragm has no hole for the front end of the operating plunger to extend therethrough, it is necessary to modify the means for connecting the plunger to the diaphragm. Such modified means will now be described.

As seen from FIG. 5, the front or active portion of the capsule diaphragm 13 has a bulbous mid-section 13*a* which is attached to a knob-like retaining assembly on the operating plunger 17 adjacent the front end thereof.

The knob-like retaining assembly comprises a clincher ring 41 molded, for example, from a suitable rubber-like plastics material, a generally mushroom-shaped retaining cap 42 secured to the front end of the operating plunger 17 by means of a screw 43, and an annular lock washer 44 having a concave front surface. Disposed exteriorly on the bulbous mid-section 13*a* of the diaphragm 13 is a ring 46 which has an inner diameter smaller than the largest outer diameter of the clincher ring 41 and smaller than the largest outer diameter of the lock washer 44.

Mode of assembly:

First, a nut 45 is threaded onto an externally threaded on a front end porion of the operating plunger 17 as far as needed. Then the lock washer 44 is put in place, followed by the ring 46, and finally the clincher ring 41 together with the retaining cap 42 is screwed onto the front end portion of the operating plunger 17. Now the capsule diaphragm 13 is attached to the plunger 17 by feeding it, rear edge first, over the retaining cap 42 and the clincher ring 41 and through a space left between the ring 46 and the clincher ring 41 and lock washer 44 (which at this point is still axially withdrawn from the clincher ring 41). When the capsule diaphragm is in place and with its bulbous mid-section 13*a* properly pulled over the knob-like retaining assembly, the nut 45 is tightened to drive the lock washer 44 firmly against the clincher ring 41, whereupon the knob-like retaining assembly is securely clamped to the bulbous mid-section 13*a* of the capsule diaphragm 13.

Referring again to FIG. 5, the end flange 21 of the pneumatic cylinder has mounted thereon an adjusting device 48 including an adjusting screw 49 the front end of which serves as a stop for the rear end of the operating plunger 17. The adjusting screws 49 can be turned to adjust the length of travel of the operating plunger and, hence, the dosage volume obtained during each suction stroke.

The embodiment in FIG. 5 differs from the embodiment of FIG. 1 also in the manner in which the space between the rear flange 2 and the capsule diaphragm 13 is pressurized. Whilst in the embodiment according to FIG. 1 this space is pressurized by supplying compressed air from the space between the end flange 21 and the piston 23 of the pneumatic cylinder, in the embodiment according to FIG. 2 the flange 2 is provided with a compressed-air inlet 50 through which the space behind the diaphragm 13 can be pressurized directly and in synchronism with pressurization of the pneumatic cylinder through the inlet 21*a* to effect movement of the piston 23 producing a discharge stroke. By means of a suitable valve control mechanism (not shown), it is also possible to utilize the compressed-air inlet 50 for releasing the pressure from the space behind the diaphragm 13 at the same time air pressure is applied to the piston 23 to effect a suction stroke.

It is also conceivable to employ means other than a pneumatically operated double-acting piston for actuating the operating plunger 17; for example, the latter could be operated hydraulically or by means of an electric motor or mechanically, in which case pressurization and pressure release would occur synchronously with the pump stroke movements in the manner illustrated in FIG. 5.

One could also connect two or more pumps of this type for parallel operation and could operate them either strictly as dosing or as dosing-and-feed pumps, either in-phase or phase-displaced. For instance, a combination of two or more dosing pumps with identical or different dosage volumes could be used to draw fluid media from different suction pipes and deliver dosed quantities thereof into a common feed pipe. Alternatively, a dosing pump or dosing-and-feed pump embodying the invention, but provided with two or more inlet ports instead of only one, could be used to suck media, either simultaneously or at different times, from different supply lines and to mix the collected media when discharging them into a common discharge line.

What is claimed is:

1. A capsule-type dosing pump comprising:

(a) a pump capsule including a stationary capsule wall provided with an inlet port and an outlet port, and a movable capsule wall comprising a capsule diaphragm;

(b) an operating member for moving said capsule diaphragm to and fro between a bulged-out position providing minimum capsule volume, and a retracted position providing maximum capsule volume, and (c) pneumatic means effective upon each movement of the capsule diaphragm to said bulged-out position thereof to effect pressurization of the space behind the capsule diaphragm, and effective upon each movement of the capsule diaphragm to said retracted position thereof to effect a pressure release from said space, (d) said stationary capsule wall including a concave surface which is curved to conform to the contour of said capsule diaphragm when in said bulged-out position, the arrangement being such that the capsule diaphragm lies flush against said concave surface when in the bulged-out position thereof, said stationary capsule wall comprising a front end flange and a tubular wall extending therefrom, and said capsule diaphragm including a substantially cylindrical portion which abuts said tubular wall.

2. A dosing pump according to claim 1, wherein said stationary capsule wall includes a base member secured to the inner surface of said front end flange, said concave surface being disposed on said base member.

3. A dosing pump according to claim 2, wherein said stationary capsule wall is provided with flow channels for conducting fluid from a central region between said inlet port and said capsule diaphragm to a radially outer region exterior to the capsule diaphragm.

4. A dosing pump according to claim 3, wherein said flow channels are formed in said base member.

5. A dosing pump according to claim 1, including a rear flange which closes said space behind the capsule diaphragm toward the rear, said capsule diaphragm having a rear end portion thereof secured to said rear flange, and said operating member being slideably supported in an opening formed in said rear flange.

6. A dosing pump according to claim 1, wherein said operating member is a pneumatically actuated plunger.

7. A dosing pump according to claim 1, wherein said operating member is a motor-driven plunger.

8. A dosing pump according to claim 5, including a pneumatic cylinder mounted on said rear flange, said pneumatic cylinder including a double-acting piston connected to the rear end of said operating member.

9. A dosing pump according to claim 8, wherein said operating member comprises a plunger having an axial bore extending therethrough, said axial bore being in fluid flow communication with the space behind said capsule diaphragm and with a space within said pneumatic cylinder adapted to be pressurized for driving said double-acting piston in a direction effecting movement of the capsule diaphragm to the bulged-out position thereof, said axial bore having associated therewith a normally closed check valve adapted to open upon pressurization of said space within the pneumatic cylinder.

10. A dosing pump according to claim 8, wherein said rear flange has formed therein an outlet passage communicating with the space behind said capsule diaphragm, said outlet passage containing a normally closed check valve having associated therewith a control piston adapted to open said check valve in response to pressurization of a space within said pneumatic cylinder adapted to be pressurized for driving said double-acting piston in a direction effecting movement of the capsule diaphragm to said retracted position thereof.

11. A dosing pump according to claim 1, wherein said operating member has a front end portion which extends through an aperture formed in a mid-section of said capsule diaphragm, said mid-section having edge portions thereof surrounding said aperture clamped between two form pieces which are secured to said front end portion of the operating member.

12. A dosing pump according to claim 1, wherein said capsule diaphragm has a bulbous mid-section, and said operating member has secured thereto, adjacent the front end thereof, a knob-like retaining assembly which is engaged with said bulbous mid-section and fixedly connected thereto.

13. A dosing pump according to claim 12, wherein said knoblike retaining assembly comprises a ring seated on said bulbous mid-section exteriorly thereof, a pair of axially aligned annular members disposed substantially within said bulbous mid-section and portions of which located in planes tangent with opposite sides of said ring have outer diameters larger than the inner diameter of the ring, and means for drawing said annular members together so as to clamp said bulbous mid-section of the capsule diaphragm securely in place.

14. A dosing pump according to claim 5, wherein the space behind the capsule diaphragm communicates with at least one passageway formed in said end flange to permit pressurization and depressurization, respectively, of said space.

15. A dosing pump according to claim 1, including an adjustable stop cooperable with said operating member to adjust the extent of suction-stroke producing travel thereof.

16. A dosing pump according to claim 10, wherein said outlet passage has a leakage detector associated therewith.

17. A dosing pump according to claim 14, wherein the passage for depressurizing the space behind said capsule diaphragm has a leakage detector associated therewith.

* * * * *